United States Patent [19]

Lee

[11] Patent Number: 5,075,590

[45] Date of Patent: Dec. 24, 1991

[54] CONVERGENCE CORRECTING DEVICE FOR IN-LINE TYPE COLOR PICTURE TUBE

[75] Inventor: Jeonghee Lee, Kyunggi, Rep. of Korea

[73] Assignee: Samsung Electron Devices Co., Ltd., Rep. of Korea

[21] Appl. No.: 548,688

[22] Filed: Jul. 6, 1990

[51] Int. Cl.[5] ..... H01J 29/76; H01J 29/56

[52] U.S. Cl. ..... 313/412; 313/428; 313/431; 313/440

[58] Field of Search ..... 313/440, 428, 431, 412

[56] References Cited

U.S. PATENT DOCUMENTS 4,882,521 11/1989 Arimoto ..... 313/440

FOREIGN PATENT DOCUMENTS 0274537 11/1987 Japan ..... 313/440
0096845 4/1988 Japan ..... 313/440
0124347 5/1988 Japan ..... 313/440
0211546 9/1988 Japan ..... 313/440
0002242 1/1989 Japan ..... 313/440
0183042 7/1989 Japan ..... 313/440

*Primary Examiner*—Palmer C. DeMeo
*Attorney, Agent, or Firm*—Cushman, Darby & Cushman

[57] ABSTRACT

A convergence correcting device for an in-line type color picture tube is disclosed. The characteristic portion of the invention includes a pair of magnets and a bobbin. The bobbin includes a vertical deflection auxiliary magnetic field generating section, horizontal deflection auxiliary magnetic field generating sections, and magnetic field adjusting sections. The vertical deflection auxiliary magnetic field generating section is disposed at the center of the device, and receives a core and a coil wound thereon. The horizontal deflection auxiliary magnetic field generating sections are disposed at the left and right of the vertical deflection auxiliary magnetic field generating sections, and receive cores and coils wound thereon. The magnetic field adjusting sections are disposed at the outsides of the horizontal deflection auxiliary magnetic field generating sections, and are provided with thread portions for coupling with the magnets.

7 Claims, 4 Drawing Sheets

CONVERGENCE CORRECTING DEVICE FOR IN-LINE TYPE COLOR PICTURE TUBE

BACKGROUND OF THE INVENTION

The present invention relates to a convergence correcting device for an in-line type color picture tube. More particularly, this invention relates to a convergence correcting device for use in a self convergence type color picture tube, in which three electron beams emitted from three electron guns arranged in an in-line form, are automatically converged by vertical and horizontal deflecting magnetic fields.

It is well known, that in front of the neck portion of a picture tube, is a deflecting means which deflects the electron beams of the electron guns to the screen.

This deflecting means is situated such that a vertical deflecting coil is installed on the outside of a funnel shaped separator in order to deflect the electron beams in the vertical direction, and a horizontal deflecting coil is installed in the inside of the funnel shaped separator in order to deflect the electron beams in the horizontal direction. A specified voltage level is applied to the vertical and horizontal deflecting coils to establish magnetic fields required to deflect the electron beams.

In a color picture tube, three electron beams pass the holes formed in a shadow mask before they land on the respective corresponding phosphorescent dots. The combinations of these landed beams form a picture in color registration. However, if such conditions are not met, then the color of the picture becomes degraded.

Such deviations can occur over the whole picture, or they can occur partially along the periphery of the picture.

If they occur over the entire picture, the advancing directions of the three electron beams are not correct. To correct the picture, the advancing directions of the three beams must be corrected. This is done by ensuring that the three electron beams which have passed through the respective holes of the shadow mask land on the correct positions on the 3-color dots.

To allow for correction of the three beams' landing positions, the vertical and horizontal deflecting coils are equipped with a magnet capable of varying the direction and the intensity of the deflecting magnetic fields, and electric currents having special wave patterns must be supplied to these vertical and horizontal deflecting coils.

An example of such a device uses a conventional in-line type self convergence deflecting yoke situated so that the deflecting magnetic field of the horizontal deflecting coil is shaped into a pin cushion form, and the deflecting magnetic field of the vertical deflecting coil is shaped in a barrel form, in order to correct the directions of the electron beams.

If the beam deflecting angle of a color picture tube is expanded to an angle greater than 90 degrees in order to make the electron beams converge to an acceptable degree, a pin cushion deformation or a barrel cushion deformation occurs to the upper and lower rasters, thereby making such a method impractical. On the other hand, if the deformations of the upper and lower rasters are adjusted to the optimum, a forward cross misconvergence or a reverse cross misconvergence occurs, also making this method impractical.

The problems of the convergence characteristics and the raster deformations present technical difficulties that have to be solved.

Japanese Patent Application No. Sho-56-91275 and 56-111650 propose devices which are allegedly capable of overcoming the problems described above. However, in these devices, the operating range of the controlling magnetic fields is limited which results in the DC bias level being too small and requires the structure to become too complicated. Laid-Open Japanese Patent Application No. Sho-60-125069 discloses another device which is allegedly capable of overcoming the problems described above. In this device, however, the difference between the misconvergence amount of the middle portion of the picture showing negligible vertical deflections and the misconvergence amount of the upper and lower portions of the picture showing maximum vertical deflections is approximately 0.5 mm. Therefore, it is not suitable for picture tubes in which the pitches of the phosphorescent dots are ultra-fine to below 0.3 mm.

The devices described above also have fixedly installed magnets making it impossible to adjust the DC bias in those devices.

SUMMARY OF THE INVENTION

The present invention is intended to overcome the disadvantages described above which are present in conventional devices.

Therefore it is the object of the present invention to provide a convergence correcting device for an in-line type color picture tube, in which an optimally harmonized picture is obtained by varying the magnetic bias by positionally adjusting a magnet, as well as minimizing the convergence by dividing the misconvergence amount.

To achieve the above object, the beam convergence correcting device according to the present invention is constituted such that: 1) a vertical deflection auxiliary magnetic field generating section for receiving a core and a coil wound thereon and connected to a vertical deflecting coil is disposed at the centre; 2) horizontal deflection auxiliary magnetic field generating sections for receiving cores and coils wound thereon and connected to a horizontal deflecting coil are disposed at the left and right of the vertical deflection auxiliary magnetic field generating section; 3) magnetic field adjusting sections respectively having a female thread are installed to the outside of the horizontal deflection auxiliary magnetic field generating section; 4) the vertical deflection auxiliary magnetic field generating section, the horizontal auxiliary magnetic field generating sections, and the magnetic field adjusting sections mentioned above constitute a bobbin; and, 5) magnets having a male thread portion for being coupled with the female thread portion and having an adjusting groove on the external surface thereof are provided.

The bobbin is fixedly fastened to the terminal board of the deflecting yoke 50 that any residual misconvergence apportioned between the two horizontal deflection auxiliary magnetic field generating sections. And the DC current bias is adjusted by positioning the magnet by turning the threaded portion, thereby minimizing the forward cross misconvergence.

BRIEF DESCRIPTION OF THE DRAWINGS

The advantages described above and other advantages of the present invention become more apparent by describing in detail the preferred embodiment of the present invention with reference to the attached drawings in which.

DESCRIPTION OF THE INVENTION

Figure 3:
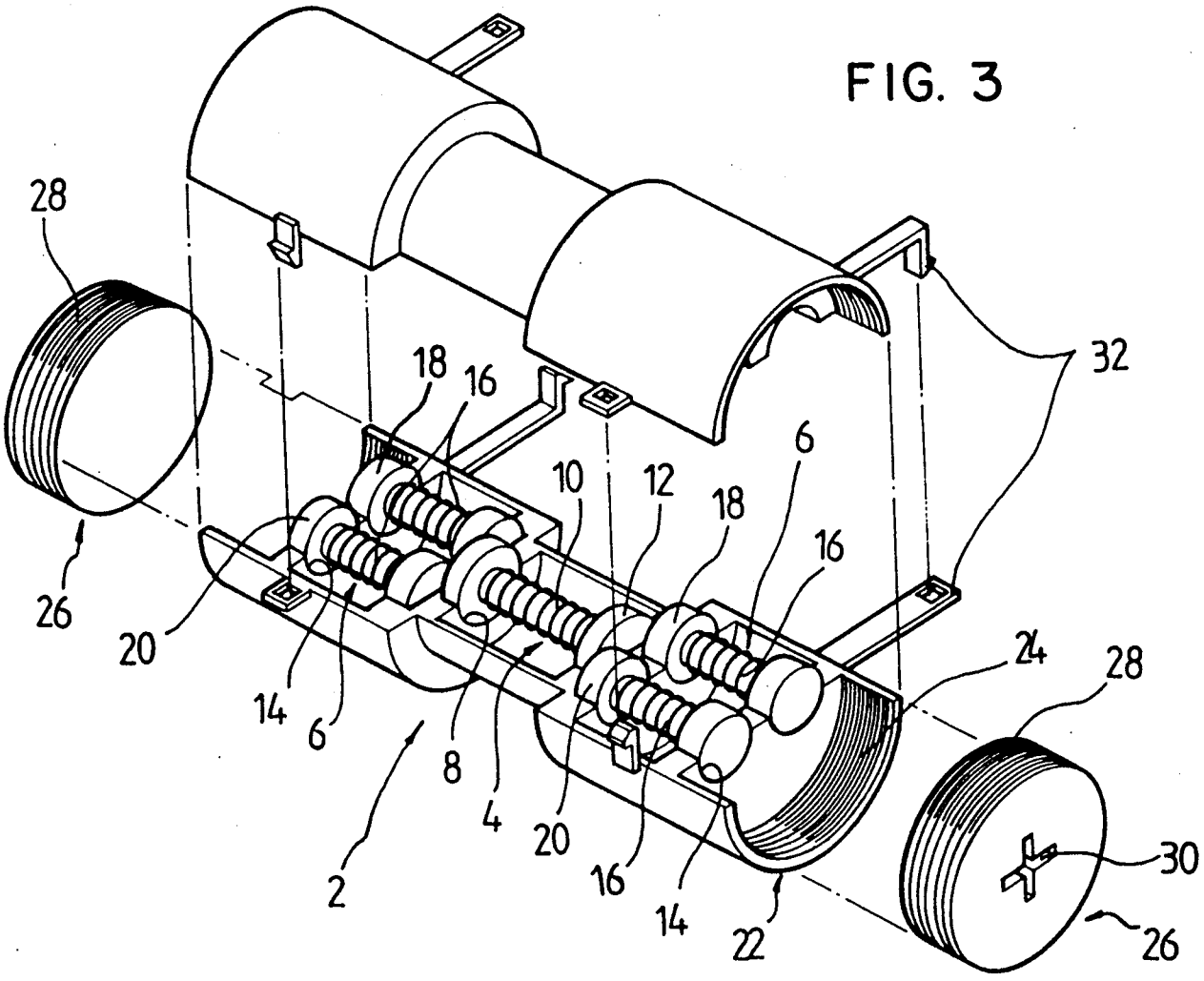
FIG. 3 is an exploded perspective view of the convergence correcting device according to the present invention.

FIG. 3 is an exploded perspective view of the convergence correcting device according to the present invention, and here, a bobbin 2 takes a symmetrical form, and includes a pair of semi-cylindrical members. The semi-cylindrical members are products of injection molding, does not affect the magnetic fields.

The bobbin 2 includes a vertical deflection auxiliary magnetic field generating section 4 at the centre thereof, and a pair of horizontal deflection auxiliary magnetic field generating sections 6 at the opposite sides of the vertical deflection auxiliary magnetic field generating section 4. The vertical deflection auxiliary magnetic field generating section 4 is provided with a semi-cylindrical recess 8, and a core 12 winding a vertical auxiliary coil 10 which is accommodated within the semi-cylindrical recess 8.

The horizontal deflection auxiliary magnetic field generating sections 6 are provided with two semi-cylindrical recesses 14, and cores 18 and 20 winding the horizontal auxiliary coils 16 which are accommodated within the semi-cylindrical recesses 6.

The vertical and horizontal auxiliary coils 10, 16 are connected to each other through vertical and horizontal deflecting coils (not shown) which are respectively disposed at the inside and outside of the deflecting yoke. A magnetic field adjusting section 22 is installed to the outside of each of the horizontal deflection auxiliary magnetic field generating sections 6. This magnetic field adjusting section 22 is provided with a female thread portion 24 on the inside thereof, and one end thereof is open so that a magnet 26 can be inserted into the opening.

The magnet 26 is provided with a male thread portion 28 on the external circumferential surface thereof, so as for the thread portion 28 to be coupled with the female thread portion 24 of the magnetic field adjusting section 22, and the magnet 26 is also provided with an adjusting groove 30.

In the case where the thread portion has pitch dimensions of 0.75 mm, the adjustability of the magnetic coupling state of the magnets 26 becomes very fine, so that the adjustment of the magnetic field can be exactly carried out.

Further, retaining means 32 are provided to the opposite sides of the semi-cylindrical members of the bobbin 2 in such a manner that the semi-cylindrical members can be securely coupled together. The retaining means 32 provided at one side of the semi-cylindrical member are longer than the ones provided at the other side thereof.

Figure 4:
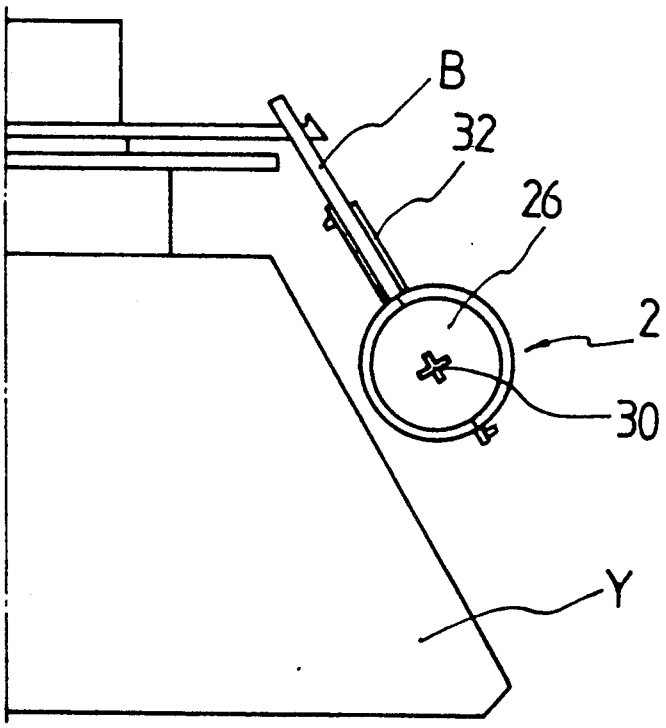
FIG. 4 illustrates the convergence correcting device of the present invention attached to a deflecting yoke.
Figure 5:
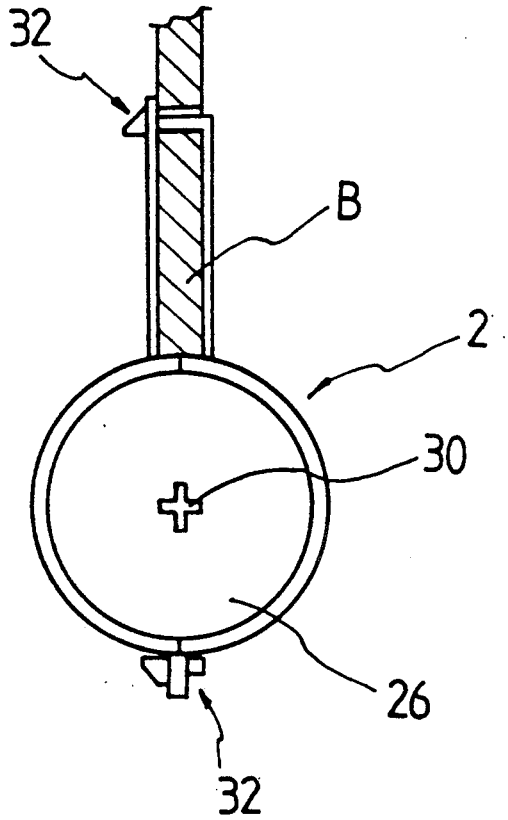
FIG. 5 is a sectional view showing the convergence correcting device of the present invention coupled with a terminal board.

Thus as shown in FIGS. 4 and 5, the retaining means 32 are supported to the terminal board B of the deflecting yoke Y.

The convergence correcting device of the present invention constituted as above is operated in a manner described below.

Figure 1:
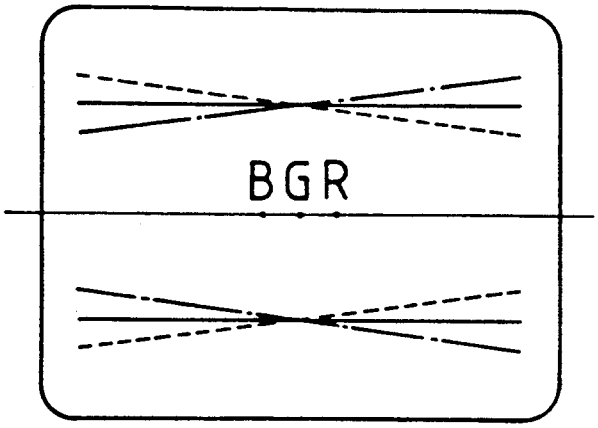
FIGS. 1 and 2 illustrate forward cross misconvergences and reverse cross misconvergences.
Figure 2:
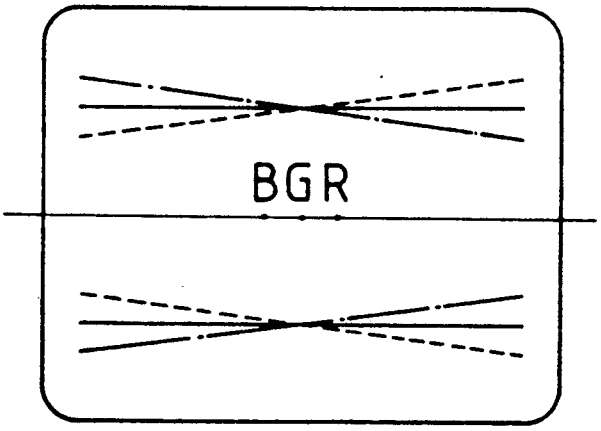

If the magnets 26 are turned by fitting a non-magnetic screw driver into the adjusting grooves 30, then the magnets 26 move to the left or right from the magnetic field adjusting section 22 depending on the turning direction of the screw driver. Thus, if a forward cross misconvergence is encountered during this convergence correcting process as shown in FIG. 1, then the study-state bias of the magnetic field is adjusted considering. the state of the misconvergence by the above described method turning the magnets 26. Then, the forward cross misconvergence will be gradually shifted to a reverse cross misconvergence as shown in FIG. 2. Thus, observing the shifting, the adjusting has to be stopped at point where the three electron beams meet completely together.

When the misconvergence is corrected by the above described method turning the opposite magnets 26, it is important that the respective magnets maintain balance. That is, the adjustments of the magnetic field bias have to be carried out in a balanced manner, if the convergence amount is to be divided, and if the correction is to be made correctly.

Accordingly, even in the case of a high resolution picture tube in which the pitch dimension is less than 0.3 mm, it becomes possible to minimize the misconvergence enough to land the electron beams exactly. The device of the present invention has a further advantage such that, once the adjustment is completed, the adjusted state is never disturbed, because the bobbin 2 and the magnets 26 are securely coupled in a threadable manner.

What is claimed is:

1. A convergence correcting device for an in-line type picture tube, comprising:

three electron guns producing three electron beams;

at least one horizontal deflecting coil producing a horizontal magentic field in a pin cushion form;

at least one vertical deflecting coil producing a vertical magnetic field in a barrel form, wherein the horizontal and vertical deflecting fields coact to create a self convergence effect which automatically converges the electron beams produced by the electron guns;

a pair of magnets having an adjusting groove on their outer surface and having a threaded portion, wherein turning the magnets adjusts a DC bias current for reducing forward cross misconvergence;

a bobbin being fixedly fastened to a terminal board of a deflecting yoke, wherein the bobbin includes:

a vertical deflection auxiliary magnetic field generating section for receiving a core and a coil wound thereon, connected to one side of the vertical deflecting coil, and disposed at the center of the bobbin;

horizontal deflection auxiliary magnetic field generating sections for receiving cores and coils wound thereon, connected to a horizontal deflecting coil, and disposed at opposed sides of the vertical deflection auxiliary magnetic field generating section, wherein the horizontal deflection auxiliary magnetic field generating section divides the residual misconvergence; and magnetic field adjusting sections having a threaded portion and being disposed externally of the horizontal deflection auxiliary magnetic field generating sections, wherein the threaded portion is coupled with the threaded portion of the magnets.

2. The convergence correcting device as claimed in claim 1, wherein the bobbin includes combinations of semi-cylindrical members.

3. The convergence correcting device as claimed in claim 1, wherein the pitches of the threads of the thread portions are 0.75 mm.

4. The convergence correcting device as claimed in claim 1, wherein the horizontal deflection auxiliary magnetic field generating sections include two cores.

5. The convergence correcting device as claimed in claim 1, wherein the magnets coupled with said magnetic field adjusting sections can be let to advance or withdraw by turning the magnets in order to adjust the convergence amount.

6. The convergence correcting device as claimed in claim 1, wherein the misconvergence amount is divided, as the current bias amount is adjusted in a balanced manner by the magnets which are coupled with said magnetic field adjusting sections which are in turn disposed at the opposite end portions of the bobbin.

7. The convergence correcting device as claimed in claim 5, wherein the misconvergence amount is divided, as the current bias amount is adjusted in a balanced manner by the magnets which are coupled with the magnetic field adjusting sections which are in turn disposed at the opposite end portions of the bobbin.

* * * * *